US007416636B2

(12) United States Patent
Blomqvist et al.

(10) Patent No.: US 7,416,636 B2
(45) Date of Patent: Aug. 26, 2008

(54) METHOD AND APPARATUS FOR FOAM FORMING

(75) Inventors: Rainer Blomqvist, Kotka (FI); Harri Kostamo, Tavastila (FI); Eino Laine, Kyminlinna (FI); Kay Rokman, Karhula (FI)

(73) Assignee: Ahlstrom Glassfibre Oy, Karhula (FI)

( * ) Notice: Subject to any disclaimer, the term of this patent is extended or adjusted under 35 U.S.C. 154(b) by 638 days.

(21) Appl. No.: 10/494,945

(22) PCT Filed: Nov. 7, 2002

(86) PCT No.: PCT/FI02/00865

§ 371 (c)(1),
(2), (4) Date: Aug. 20, 2004

(87) PCT Pub. No.: WO03/040469

PCT Pub. Date: May 15, 2003

(65) Prior Publication Data

US 2005/0039870 A1 Feb. 24, 2005

(30) Foreign Application Priority Data

Nov. 9, 2001 (FI) ..... 20012168

(51) Int. Cl.
*D21F 11/00* (2006.01)

(52) U.S. Cl. ..... 162/101; 162/123; 162/190; 162/264; 162/336; 162/343

(58) Field of Classification Search ..... 162/101, 162/336, 343, 189–190, 264, 123, 125–129, 162/289

See application file for complete search history.

(56) References Cited

U.S. PATENT DOCUMENTS

| | | | | | |
|---|---|---|---|---|---|
| 3,007,840 | A | * | 11/1961 | Wilcox | 162/101 |
| 3,716,449 | A | * | 2/1973 | Gatward et al. | 162/101 |
| 3,837,999 | A | * | 9/1974 | Chung | 162/101 |
| 3,846,232 | A | * | 11/1974 | Kankaanpaa | 162/301 |
| 3,871,952 | A | * | 3/1975 | Robertson | 162/101 |
| 3,892,622 | A | | 7/1975 | Skaugen | |
| 4,062,721 | A | * | 12/1977 | Guyer et al. | 162/101 |
| 4,443,299 | A | * | 4/1984 | Cheshire et al. | 162/264 |
| 4,486,268 | A | | 12/1984 | Nuttall et al. | |

(Continued)

FOREIGN PATENT DOCUMENTS

EP 0 158 938 10/1985

(Continued)

OTHER PUBLICATIONS

Korean Office Action dated Mar. 17, 2008 (5 pages).

(Continued)

*Primary Examiner*—José A Fortuna
(74) *Attorney, Agent, or Firm*—Nixon & Vanderhye P.C.

(57) ABSTRACT

The present invention relates to a method and apparatus for foam forming, wherein fibrous foam suspension is introduced from the head box (78, 178) of a production machine to the web forming section thereof. At least one solid material is mixed into the foam in the head box (78, 178). The method and the apparatus of the invention are particularly suitable for manufacturing various web-like products of cellulose, glass fiber, aramide, sisal, or other corresponding fibre material.

47 Claims, 7 Drawing Sheets

U.S. PATENT DOCUMENTS

Figure 1:
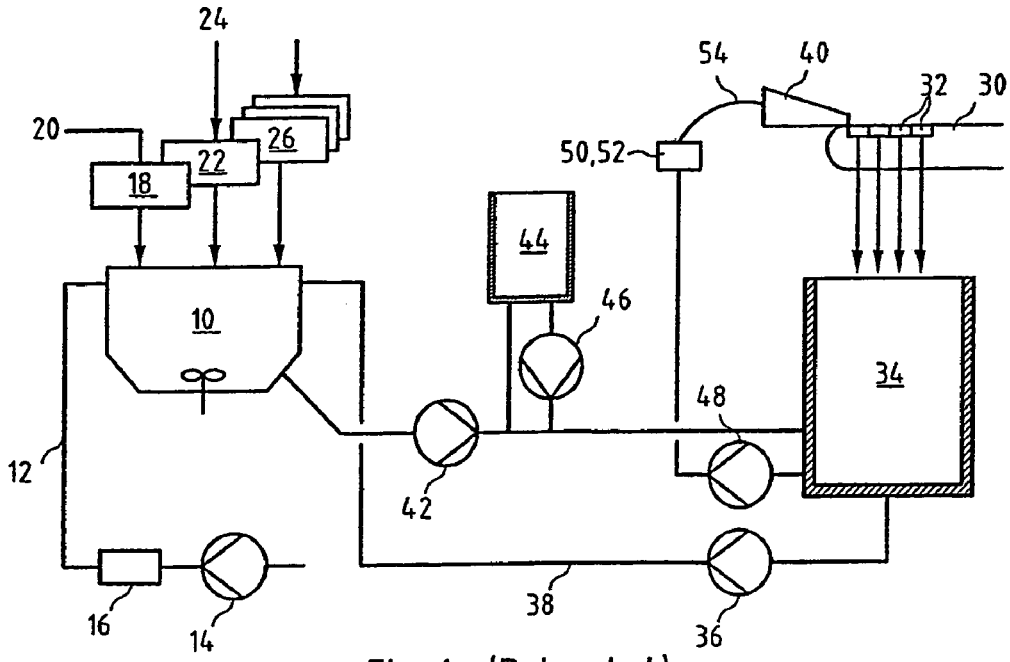
Fig. 1 (Prior Art)

| | | | | | |
|---|---|---|---|---|---|
| 4,543,156 | A * | 9/1985 | Cheshire et al. | 162/101 |
| 4,686,006 | A * | 8/1987 | Cheshire et al. | 162/336 |
| 5,164,045 | A * | 11/1992 | Awofeso et al. | 162/101 |
| 5,720,851 | A * | 2/1998 | Reiner | 162/101 |
| 5,904,809 | A * | 5/1999 | Rokman et al. | 162/101 |
| 6,019,871 | A * | 2/2000 | Rokman et al. | 162/101 |
| 6,136,153 | A | 10/2000 | Rokman et al. | |
| 6,238,518 | B1 | 5/2001 | Rokman et al. | |
| 6,258,203 | B1 * | 7/2001 | Rokman et al. | 156/296 |
| 6,413,368 | B1 * | 7/2002 | Dwiggins et al. | 162/101 |
| 6,500,302 | B2 * | 12/2002 | Dwiggins et al. | 162/101 |
| 6,835,418 | B2 * | 12/2004 | Capizzi | 427/296 |
| 6,875,308 | B2 * | 4/2005 | Kajander et al. | 162/135 |
| 6,921,459 | B2 * | 7/2005 | Kinsley et al. | 162/101 |
| 2002/0066544 | A1 * | 6/2002 | Dwiggins et al. | 162/158 |
| 2002/0092635 | A1 * | 7/2002 | Capizzi | 162/158 |
| 2003/0139111 | A1 * | 7/2003 | Kajander et al. | 442/370 |
| 2003/0193836 | A1 * | 10/2003 | Kinsley et al. | 366/307 |
| 2005/0039870 | A1 * | 2/2005 | Blomqvist et al. | 162/101 |
| 2005/0092417 | A1 * | 5/2005 | Billgren et al. | 156/62.2 |
| 2005/0136241 | A1 * | 6/2005 | Kajander et al. | 428/316.6 |

FOREIGN PATENT DOCUMENTS

| | | | |
|---|---|---|---|
| EP | 158938 | A2 * | 10/1985 |
| EP | 554010 | A1 * | 8/1993 |
| EP | 1 461 494 | | 5/2007 |
| FR | 1449737 | | 8/1966 |
| RU | 2 304 187 | | 8/2007 |
| WO | WO 03040469 | A1 * | 5/2003 |
| WO | WO 2005042825 | A1 * | 5/2005 |

OTHER PUBLICATIONS

Canadian Office Action dated Apr. 7, 2008 (3 pages).

* cited by examiner

METHOD AND APPARATUS FOR FOAM FORMING

This application is the US national phase of international application PCT/FI02/00865 filed 7 Nov. 2002 which designated the U.S. and claims benefit of FI 20012168, dated 9 Nov. 2001, the entire content of which is hereby incorporated by reference.

The present invention relates to a method and apparatus for foam forming. The method and apparatus of the invention are particularly suitable for forming various web-like products of cellulose, glass fibre, aramide, sisal, or other corresponding fibre material. The method and apparatus of the invention are particularly suitable for manufacturing sophisticated multi-layer laminates or composites for use in, e.g. various vehicle chassis parts, machine and apparatus enclosures and other almost innumerable applications. The method and apparatus of the invention is meant to be used in the manufacture of products utilizing long fibres or even continuous yarns, ribbons or nets. The foam as described in the invention means a foam mainly composed of water and a surfactant.

Products according to a preferable embodiment of the invention are in many cases meant to replace sheet metal structures previously used for the same applications, because the sheet metal structures and other corresponding metal structures require a great deal of care and maintenance both during manufacture and use in order to avoid, for example, rusting. Metal structures are also sensitive to even small impacts, as the impact will either cause simply aesthetic transformations or also damage the paintwork. These will, in consequence, cause rusting, especially in applications where the structures are subjected to corroding substances.

Various laminates and composites are more durable in the above-mentioned applications, but their price is in some cases slightly higher than that of the above-mentioned sheet metal structures. One of the reasons for the high cost is the complex manufacturing technology. The following example relates to the manufacture of a bonnet or a wing of an automobile.

It goes without saying that the part of a bonnet or a wing of an automobile visible to the outside must be very smooth. In any other case a painted surface the hull of a boat is another example of this will unevenly reflect light, which is considered a sign of low quality and bad manufacturing precision. In other words, laminates are required to exhibit similar surface smoothness as that of the metal sheets. In practice this means, that if the product is manufactured from, for example, glassfibre, a very fine-grained fibre must be used. A characterizing feature of such a fine-grained fibre is that a laminate produced therefrom will not be sufficiently durable for use, for example, as an automobile wing. Therefore a glassfibre wing must be manufactured from several different layers. The demand for strength and durability dictate that there be a structural layer With relatively coarse fibres, about 45-50 mm in length, sometimes more than that, sometimes less.

As a minimum, the above-mentioned two layers would be sufficient for achieving the necessary appearance and strength, but automatizing the production causes problems. First, it's obvious that the process needs a mould to closely reproduce the form of the product. The easiest way would be to arrange just a one-part mould, into which the surface mat is first placed, followed by resin. After this the reinforcing mat would be laid, on top of which is laid another layer of resin, subsequent to which the layers would be rolled together to remove any air bubbles. This kind of manufacture would, however, be totally manual, as both the spreading of resin and rolling the air bubbles must be visually monitored. In addition to this, a laminating process like this is a health risk even in good conditions, due to the gases formed during production.

The above-mentioned manual work has in the industry been replaced by a method in which resin is laid on top of the surface layer in the mould, subsequent to which a reinforcing, for example, mat is laid on top of the resin. Thus formed, the laminate is then pressed into its shape by means of the other half of the mould, which also causes the resin to press through both layers. U.S. Pat. No. 5,672,309 discloses an injection method, in which a surface layer is first placed in a mould, with another layer placed on top of it. One of the layers has an opening at a desired place. These two superimposed layers are then to some degree pressed against each other by means of the other half of the mould so that the edges of the mould start to tighten. In this phase, resin is injected between the layers through the hole in one of the layers corresponding with a nozzle in either half of the mould by means of the nozzle so that when the mould is fully closed, the resin spreads throughout the mould and impregnates both layers.

A further development of this is the vacuum injection moulding method, wherein the mould consists of two pieces placed against each other with the necessary glassfibre layers laid between. The published JP application 58-168510 in principle mentions this manufacturing technique. In addition to this, openings have been arranged in the piece or pieces of mould to inject resin into the mould and, accordingly, openings have been arranged for removing the air replaced by the resin. The term vacuum injection moulding is used, when suction is used for removing the air mentioned.

If the above-mentioned product, i.e. a wing of an automobile, is produced from the two layers mentioned, the surface layer and the reinforcing layer, it will soon be noted, that the resin does not spread well in the glassfibre layers unless the resin is introduced between the layers while the mould is slightly open, as described in U.S. Pat. No. 5,672,309 or unless openings are provided very close to each other at least on the side of the mould facing the reinforcing layer. The reason for this is that, when pressed together, the layers of glassfibre do not allow the resin to freely flow in the direction of the actual layer, but the main direction of the resin flow is perpendicular to the layers. So, i, it is desired to manufacture the product from these two layers by means of the vacuum injection moulding method, the mould would either have to be partly open or one of the mould halves would have to be almost totally perforated to allow the resin spread evenly inside the mould. The latter is, however, unnecessarily expensive a solution, as each resin inlet opening will in practice necessitate a resin feed tube with a conduit connected thereto.

To remedy this drawback it has been suggested that a special flow layer be used, the layer consisting of relatively thick, possibly even hollow fibres, whereby even a resin flow in the direction of the layer would be facilitated. It would naturally be preferable if the flow layer could function as a reinforcing layer or a surface layer of the product, but in practice this is not possible, especially for the surface layer, because of the coarse structure of the flow layer fibres. The smoothness of the surface layer would not satisfy the demands of the finished product. Thick and/or hollow fibres would not either afford the reinforcing layer maximal strength, whereby they can not be used in the reinforcing layers in at least demanding applications.

Thus, the result is a situation, where at least three different layers are needed in this example, unless one uses the method of partially open mould as described in U.S. Pat. No. 5,672,309. In other cases, the following layers are necessary: a surface layer on the outside of the product, a reinforcing layer on the inside and a flow: layer between these two layers.

If the manufacturing process, considering the whole manufacturing chain, is to be automatized, we can describe the prior art method of manufacturing the product. This is well described in the above-mentioned Japanese published application JP 58-168510. The publication discloses how each layer is separately laid into the mould, subsequent to which the mould halves are pressed together and the resin is injected into the mould. In other words, each of the layers of the laminate is brought separately into the mould. In practice this means that each layer is produced separately, transported separately and each layer is unrolled into the mould from its own roll.

The reason for separately manufacturing each layer is that until now there have not been methods for manufacturing multi-layer products to reach a sufficient quality of the end product for both the appearance and the strength.

An intermediate step to be mentioned is a manufacturing method in which separately produced webs are combined by stitching so that at best, only one multi-layer fibre mat needs to be laid into the mould. However, it has been noted that even though handling of the fibre mat has been facilitated and the manufacture of the product has thereby been simplified, the end result is not quite as good as one could suppose. Stitching the various webs together creates transformations in the surface layer as well, whereby the stitches are visible in the surface of the end product, even though the surface itself were smooth. This will in effect lead a situation where the reinforcing layer and the flow layer can be stitched together in the three-layer product used as an example, but the surface layer has to be kept separate. In other words, the extra step of stitching reduces the number of separately handled mats from three to two. This casts some scepticism on the use of stitching.

There are a number of ways to produce the webs used as layers of the laminate. These are the so-called water method, best known from the web forming system used in a paper machine, foam method, developed by Wiggins Teape since the 1970s, and the so-called dry method. All these above-mentioned methods can be used for producing multi-layer products when needed, but until now none of the methods has been capable of producing a product of sufficient quality for the products discussed in this application.

In the water method, the problems with the fibres used in the above-mentioned solutions have been the uncontrolled flocculation of the fibres already in the head box, curling of the fibres, opening of the fibre flocks and so on. A reason for the above-mentioned problems is the powerful turbulence of the water method, which on the one hand opens already bound homogenously sized flocks and on the other hand curls single flocks, and as it mixes the suspension gives the curled fibres a possibility to collect and bind also other fibres together into unopened fibre flocks. In addition, water method is very sensitive to consistency changes, which in effect means that the consistency must be kept constant with utmost care in order for the method to even function.

When using the water method for producing multi-layer products, the fibre layers are mixed even too thoroughly because of the great turbulence level of the water method, so that the different layers cannot perform their assigned tasks in the best possible way. It must additionally be considered that the water method has from the start been developed for use in forming webs of cellulosic fibres, for which it seems to be very suitable. In other words, the size and stiffness of cellulosic fibres is suitable for water suspensions. Thus, the turbulence present in water method does not curl the cellulosic fibres or excessively mix them, but optimally as far as web forming and the operation of the head box is concerned. Because different laminates and composites, however, use a variety on fibres, most often starting from glassfibre and ending sometimes, for example, with aramide fibres, sometimes carbon fibres or even sisal or jute fibres, the requirements of the fibres set on of the web forming process are quite different from the requirements in the treatment of cellulosic fibres. For example, the size and rigidity of the fibres used in laminates and composites alone greatly differs from the size and the rigidity of the cellulose fibres.

The turbulence level present in the water method greatly depends on the viscosity of the water, which in effect means that the turbulence level is relatively constant, at least as far as the requirements of the various fibres are concerned. This naturally means that with some fibre types, for example polyester and viscose fibres, turbulence causes the fibres to bend and twist, which causes the fibres to twist around each other, forming knots and great fibre accumulations that cannot open at any subsequent step of the process.

In the dry method, on the other hand, it is difficult to establish any kind of natural bonds between the fibre layers, because there is no mixing turbulence between neither single fibres or fibre flocks nor between the fibre layers. Instead, each layer will form its own, easily detachable layer, and this will inevitably affect the quality of the end product. In the air method the length of the fibres is limited, because the fibres are spread onto the Webb from a screen that cannot operate with long fibres. If it is desired to attach the fibre layers to each other when using the air method, the layers will have to be stitched, which causes impressions on surface of the stitched layers, or a special gluing between the layers. This will, however, stiffen the product and make it difficult to roll. In addition, rolling a rigid product may cause ruptures between the layers, which will also affect the quality of the product. It is additionally typical of the air method that there will be relatively large local fluctuations of the grammage.

The foam method is situated between these two web forming methods as far as, for example, the turbulence level is concerned. The turbulence properties of the foam method are completely different from those of the water method. In the foam method, turbulence is typically only used for forming the foam, not after a homogenous foam has been formed. In other words, when producing a foam suspension in a mixing pulper, heavy turbulence is used, even though the turbulence level is, compared to the water method, smaller by a magnitude or a number of magnitudes, which means that in a foam suspension the fibres are not curled or damaged as easyly as in a water method. When moving the foam suspension from the mixing pulper to the head box, the flow is practically totally laminar, as well as in the head box itself. In a foam suspension, the fibres are bound to foam bubbles and with the bubbles, they stay essentially immobile in relation to each other until the foam collapses on the wire of the production machine under the influence of the suction boxes.

In the foam method, the consistency is not as critical as in the water method, even though the consistency of the foam suspension is a significant factor when looking for an optimal manufacturing method for each application. The basic idea in the foam method is to bind individual fibres or fibre bundles of the desired size to a foam bubble or bubbles so that the fibres or fibre bundles are not driven into contact with each other before web forming, as that might cause formation of undesired flocks.

We have noticed, that in practice the most usable method for producing both single- and multi-layer products is the foam method, by means of which each of the different fibre types can be treated in an optimal way. The foam method has not either remained the method as originally developed by Wiggins Teape and disclosed in, e.g. U.S. Pat. No. 3,938,782. In the method (FIG. 1) disclosed by the patent the initial material, for example, fibres, surfactants, pH regulators and stabilizers etc. are introduced into a mixing pulper in carefully weighed doses, into which pulper is fed both foam from for example the wire pit of the production machine and water, also available from the liquid circulation of the production machine. In most cases, all initial materials needed for the web forming cannot for various reasons be pulpered together in one and the same pulper, but it is necessary to use a number of pulpers. Especially when forming a multi-layer web it is a known fact that the number of pulpers must at least be equal to the number of the layers of the web. These materials are formed into a foam suspension in a pulper or pulpers, and the suspension is pumped with custom-designed pump either to a production machine or temporarily into a storage tank.

Figure 2:
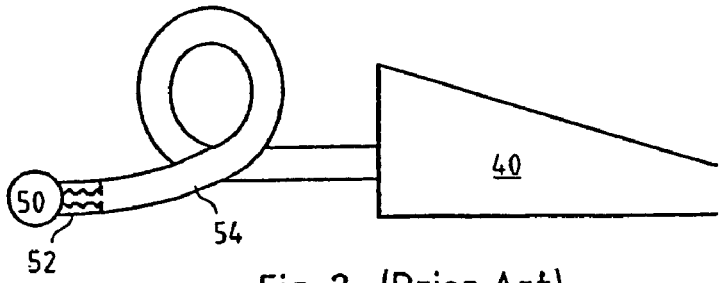
Fig. 2 (Prior Art)

The foam suspension introduced into the production machine is usually introduced into the inlet tubing of the head box via a wire pit. In a wire pit the consistency of the foam suspension is adjusted to the desired level. The feed tubing in the head box consists of a header, nozzles arranged in connection with it and the tubing leading from the nozzles to the head box. Conventionally the tubing consists of numerous flexible plastic and rubber tubes, arranged to form loops as described in U.S. Pat. No. 3,938,782 (FIG. 2). The tubing is to create and maintain turbulence together with the nozzles located at the junction of the header and tubing so that the foam suspension stays uniform. From the tubes, the foam suspension is introduced into the head box, the design of which can be very simple.

The solutions described in U.S. Pat. No. 6,019,871 (FIG. 3), U.S. Pat. No. 6,136,153 (FIG. 5) and CA patent application 2301995 (FIG. 4) can be mentioned as examples of prior art head box designs. The head box is used to dose the foam to form an even web on the wire. The grammage of the web can be adjusted, for example, by means of feeding clean foam into the head box, depending on the feeding point, either to dilute the consistency of the original foam suspension or locally thin out the layer thickness of the original fibrous foam suspension.

Figure 5:
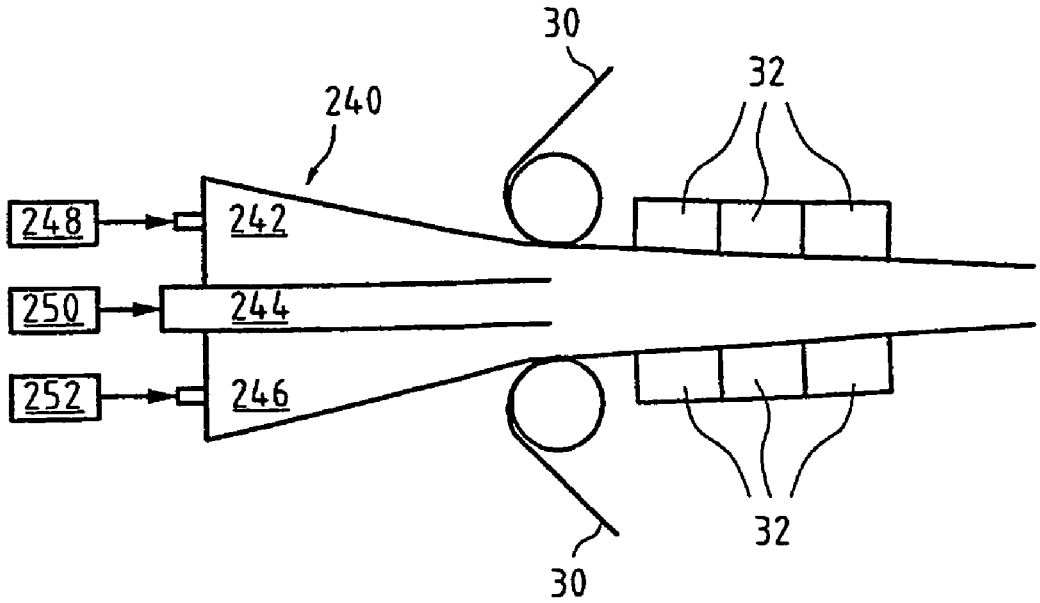
Fig. 5 (Prior Art)

When producing multi-layered products, i.e. performing a so-called multi-layer web forming, the head box can consist of a number of compartments, each of which operates independently. An example of such design is illustrated in FIG. 5 (U.S. Pat. No. 6,136,153). In some cases multi-layer web forming can also be performed so that special feed tubes (FIG. 6; U.S. Pat. No. 6,238,518) either arranged inside the head box or taken through the head box are used for feeding the desired foam suspension, at a desired place, inside the web formed by the head box.

It has however, been found in tests, that both the prior art process of producing foam and the feeding of foam suspension into the head box are unnecessarily complex. Even more so, as for example the feed tubing has been found to form a problem in the loam suspension feed apparatus. Both actual processes and tests have shown that these tubes are prone to plugging. In practice this happens so that a single fibre, for example a curled fibre or a flock of fibres, is caught either inside the tube or at the opening of the tube, and the caught fibre or flock then catches more fibres, thereby increasing the size of the flock. In the beginning the flock is very porous, so that liquid and/or gas can still pass through it, causing fibres and possibly other solids to get caught in the flock while liquid and/or gas still flows through. Having increased in size for a while and getting progressively tighter and tighter attached to the tube or its opening the flock will also start to affect the flow of liquid and/or gas, finally causing the flow through the tube to stop. Clogging of one of the tubes of the tube system will immediately cause a change in the head box that can be reflected in a quantity large enough to affect the web discharged from the head box. Even if it is possible to flush these clogged tubes, if such a possibility has been provided for in the design of the apparatus, without totally stopping the production process, it will in even the best case demand plenty of work and in the worst case relatively large production losses. It has further been noted, as is quite natural, that the longer the fibres of the material are, the more easily the tubes and the header are blocked. Naturally, the type of the fibres used, mainly the form and the rigidity of the fibres, have an effect on both how fast the fibre flocks are formed and thus also on the clogging tendency of the tubes.

Thus, the prior art foam process, or actually the head box solution used therein is not always suitable for treating foam suspension having long fibres. It is after all a fact that depending on the fibre type the traditional head boxes used in the foam method—or rather the tube system thereof—are only capable of treating fibres that are less than 50-100 mm in length.

In some cases, for example treating thin, soft and/or long fibres, e.g. 1,7 dtex polyester and viscose fibres exceeding 30 mm in length, turbulence is not useful at all. With these fibres, even a prior art foam method cannot be used, as even a relatively small turbulence present in the mixing pulper will bend the fibres and mix them so as to get twisted around each other and to form flocks that negatively affect both the process and the end product. The water method is also totally out of the question because of the turbulence, which is higher than in the conventional foam process.

Adding some water-absorbent materials to the web has also been identified as a problem. This problem is discussed e.g. in U.S. Pat. No. 6,019,871. In this patent, the foam method has been found to be essentially better than the conventional water method, but as foam also contains water, this prior art loam method also has its drawbacks. The drawback is that for example a water-absorbent polymer used is subjected for a long time to the water present in the foam and thereby almost completely loses its effect. The above-mentioned publication tries to solve the problem by for example deep-freezing or at least cooling the polymer, coating the polymer or just by introducing the polymer as late as possible to the foam suspension being fed to the wire. All the listed measures necessitate special arrangements which naturally will increase production costs.

Even though the prior art foam method as such is quite useful for producing multi-layer products, such as triple-layer products, it has been impossible to produce by means of a prior art foam method, a product favouring long fibres because the tube systems mentioned previously have been found to clog with even shorter fibres. A partial reason for the clogging is that the less rigid fibres will bend, curl and form flocks already in the mixing pulper, while forming the foam suspension.

Figure 7:
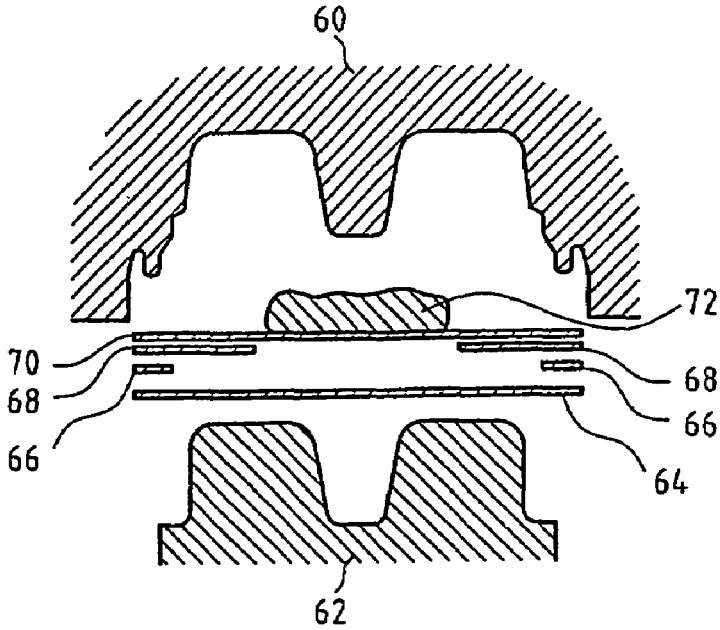
Fig. 7 (Prior Art)

In FR patent publication 1,449,737, fibers and the liquid from the wire are fed to the 'pulper-like' mixer preceding the wire. In the mixing process either a mechanical mixer or ultrasound mixing are used, which are either not useful or is not economical in foam forming, in which for example very long fibers or even net are fed in to the head box. The operation of the 'pulper-like' mixer of the FR patent publication mentioned in the fashion of a head box, among other things in order to spread foam suspension evenly onto the wire, remains also unclear We discuss the manufacture of a vehicle bumper, as disclosed in U.S. Pat. No. 6,231,094, as another example of the problems connected with traditional layered materials. This bumper consist of, as shown in FIG. 7, two webs made preferably of fibre-containing thermoplastic webs spanning the whole bumper and of narrower, also fibre-containing thermoplastic ribbons that will reinforce the body of the bumper in the desired places. According to the publication all six webs or ribbons are separate and they are put into contact with each other only at the manufacturing phase. It is not difficult to imagine how precise and demanding it is to lay the webs and especially to keep them in place when the mould is closed.

The method and apparatus according to the invention solves, among others, the above-mentioned problems, a characterizing feature of the invention being that the dry materials and the foam are not mixed together to a foam suspension until they are in the head box, immediately before introducing the suspension on the wire of the production machine, by introducing the foam at a high pressure from nozzles into the head box.

Therefore, no pulper is necessary for mixing the fibrous material into the foam in the method according to the invention. Thereby there is no need for foam pumps or tubes from the header box, not to mention the tubes between the header box and the head box.

Further, the method according to the invention is totally insensible to the materials used in the foam method. The length or rigidity of the fibre can be freely chosen, because the fibre can not clog a thin tube, as there are no such tubes on the route of the fibre to the wire.

Using the method and apparatus according to the invention it is possible to introduce into one or more layers of the formed web for example a continuous fibre, yarn, ribbon, net or almost any component unecessary in the end product.

Other characterizing features of the method and apparatus according to the invention will become clear from the appended claims.

Figure 3:
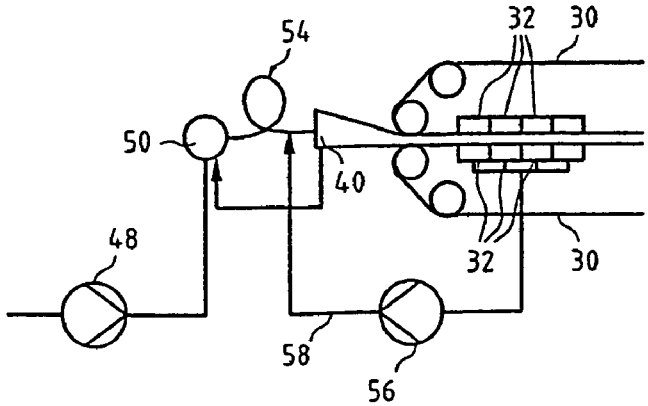
Fig. 3 (Prior Art)
Figure 4:
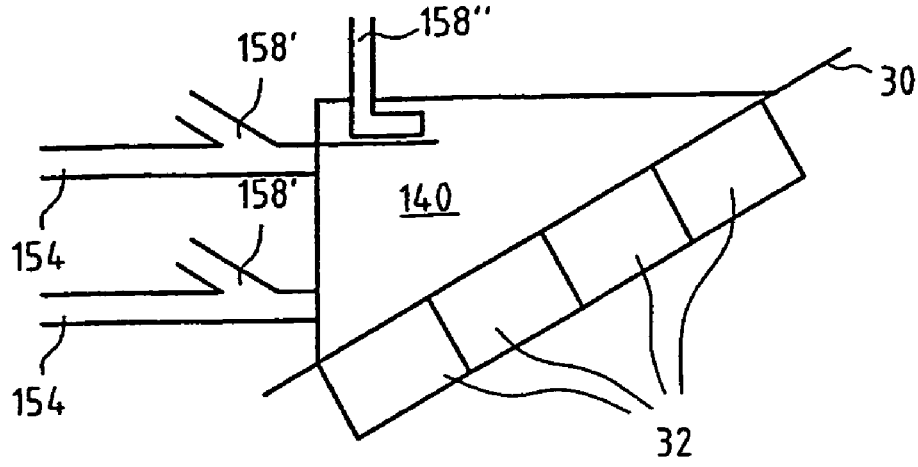
Fig. 4 (Prior Art)
Figure 6:
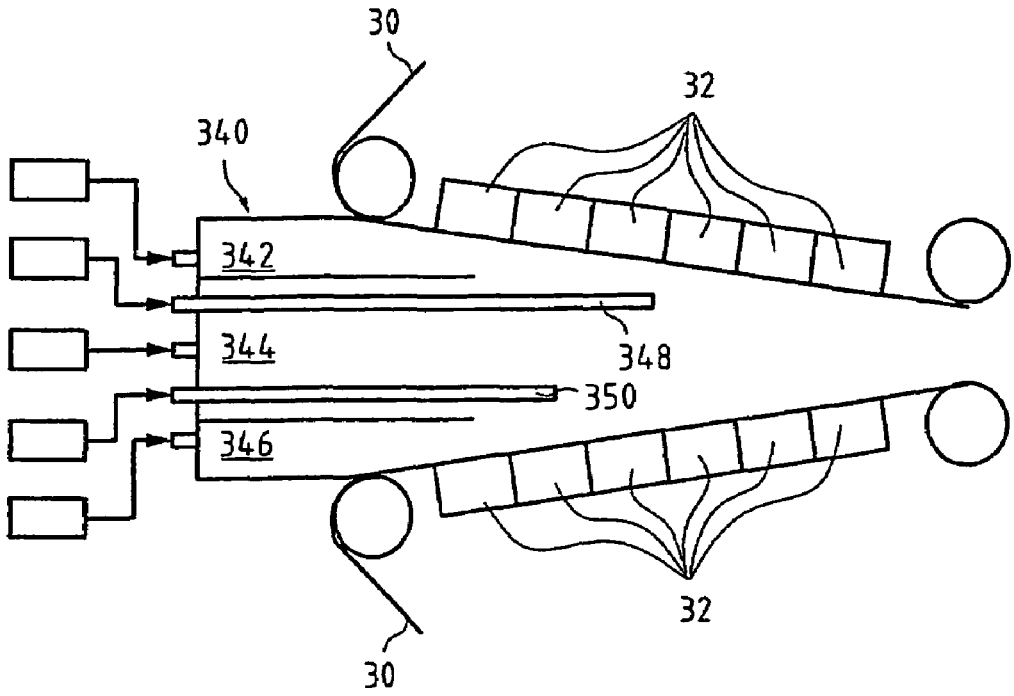
Fig. 6 (Prior Art)
Figure 8:
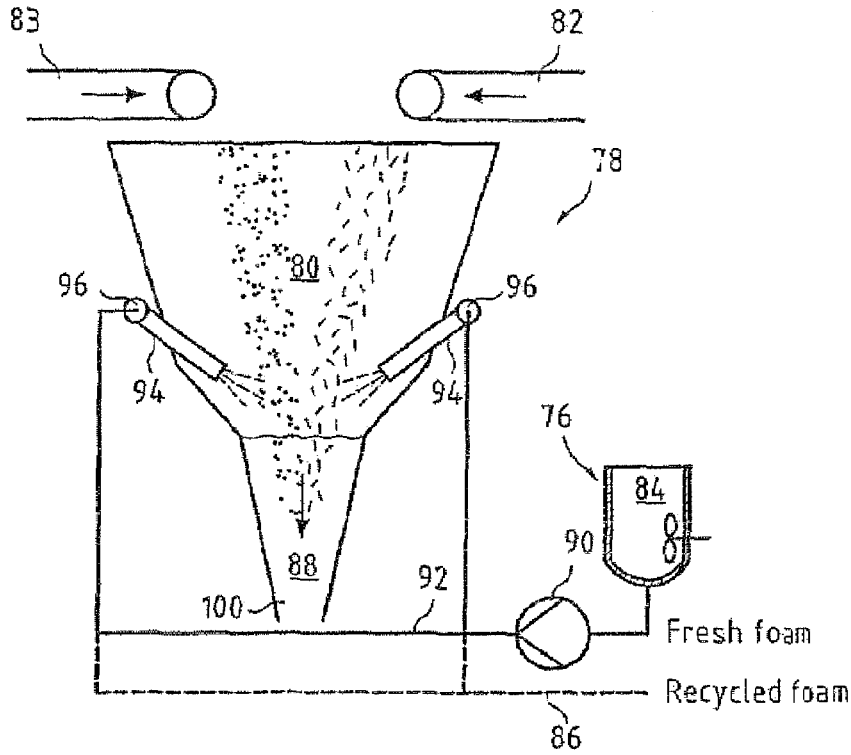
Figure 9:
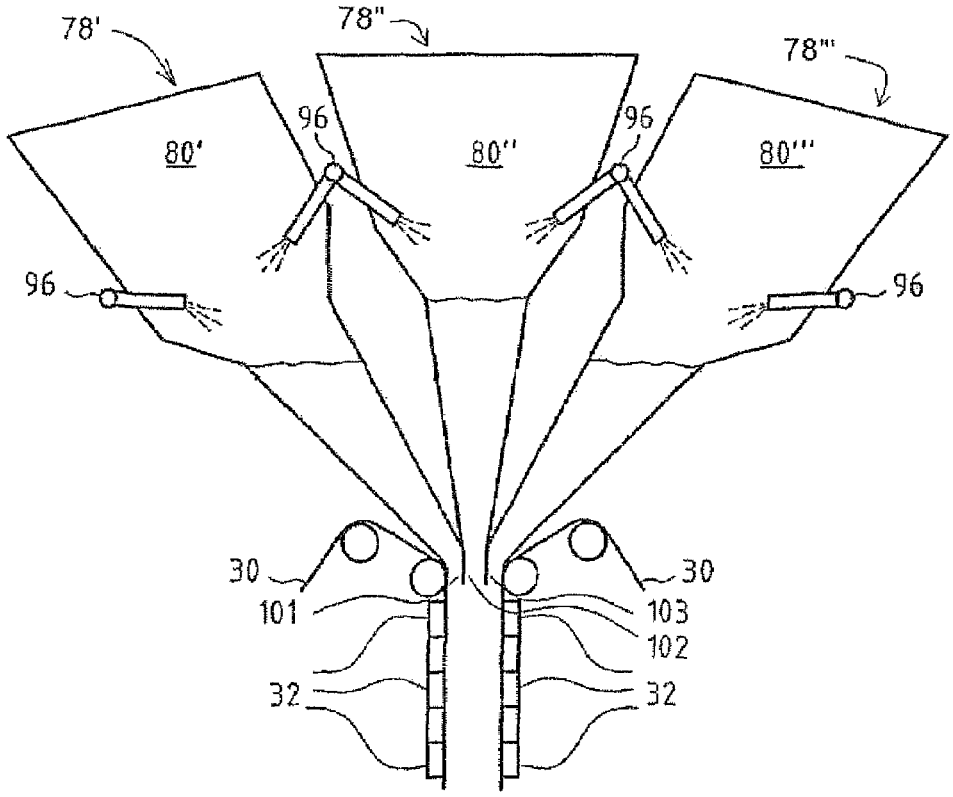
Figure 10:
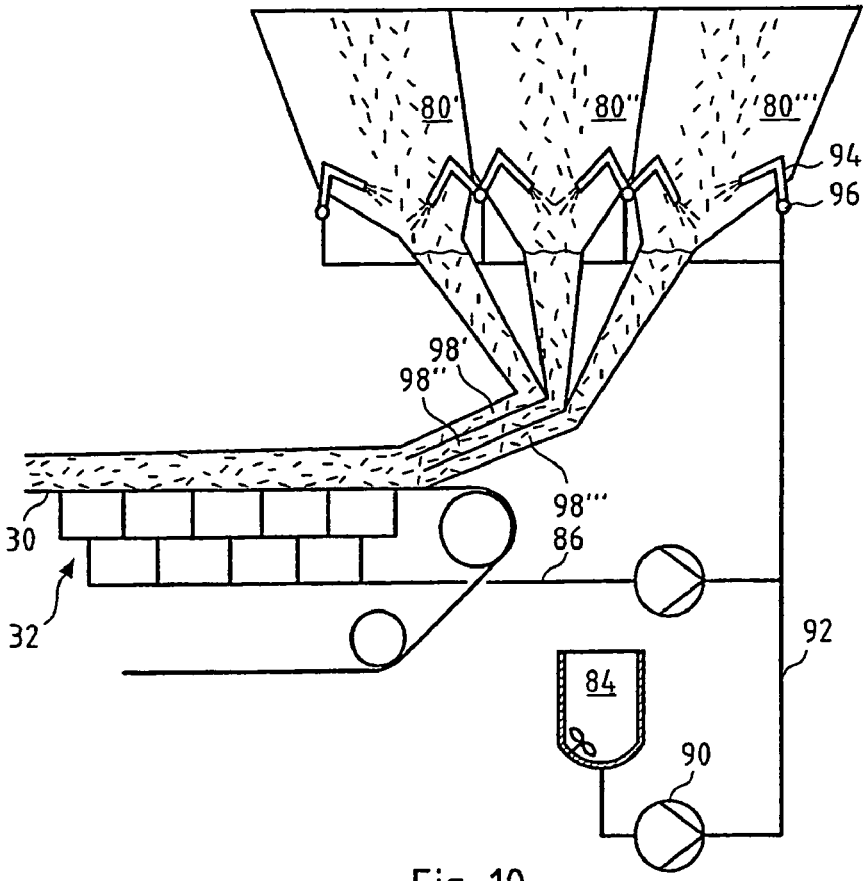
Figure 11:
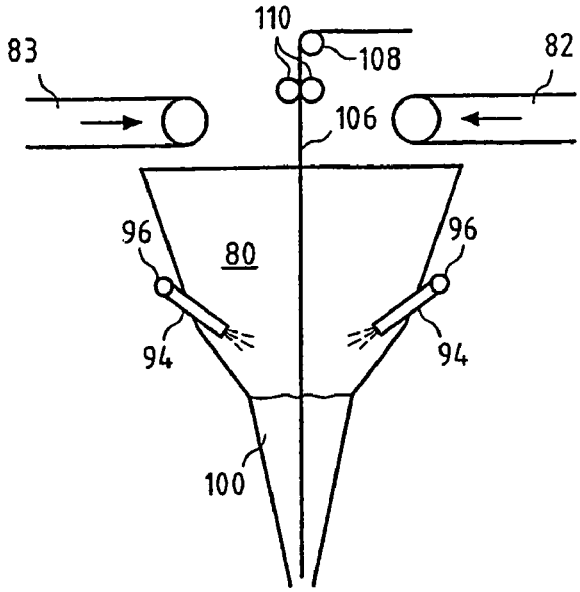
Figure 12:
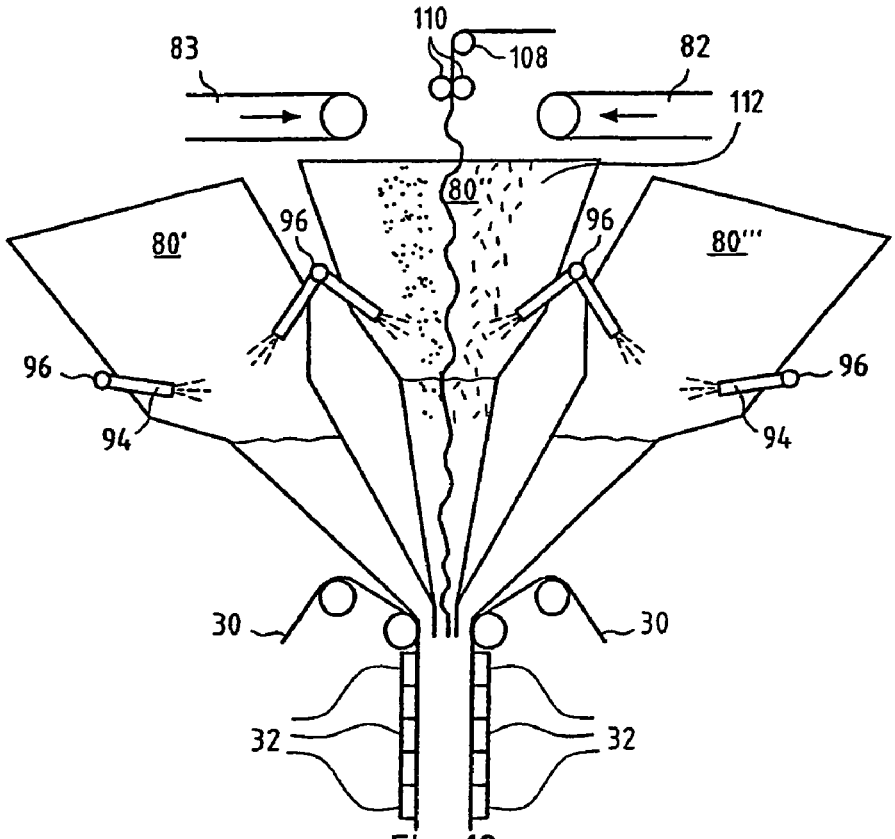
Figure 13:
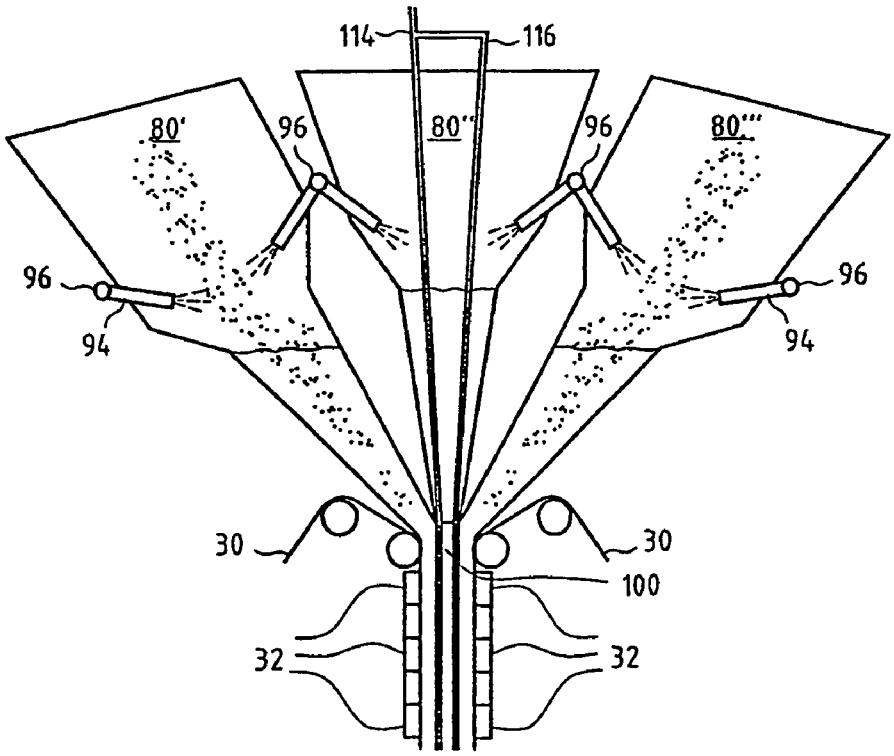
Figure 14:
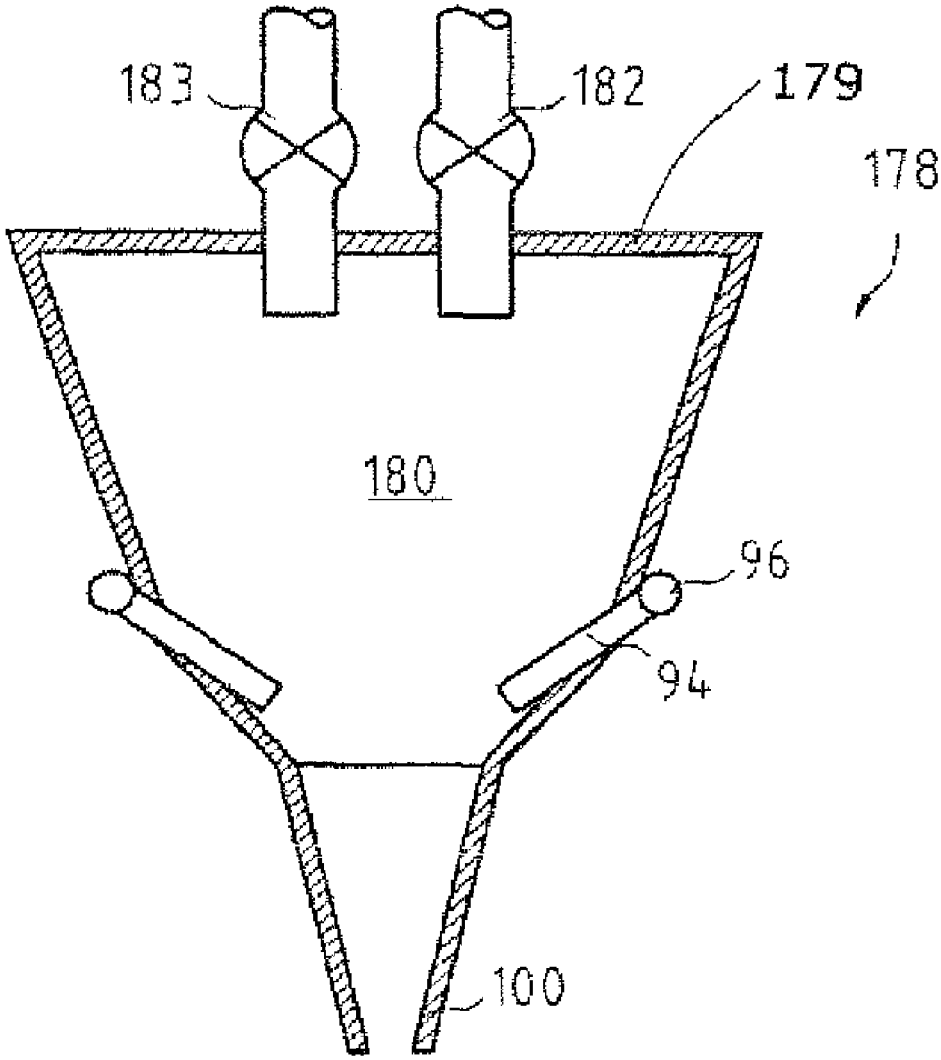

In the following, the apparatus and method according to the invention are described in more detail, with reference to the appended drawing figures, of which FIG. 1 schematically shows a prior art foam method apparatus, FIG. 2 shows a detail of a head box used in conjunction with a prior art foam method, FIG. 3 shows a head box used in conjunction with a prior art foam method, FIG. 4 shows a head box used in conjunction with another prior art foam method, FIG. 5 shows a head box used in conjunction with a third prior art foam method, FIG. 6 shows a head box used in conjunction with a fourth prior art foam method, FIG. 7 deals with the manufacturing of a vehicle bumper body according to a prior art method, FIG. 8 shows a head box according to a preferable embodiment of the new invention, representing a new concept FIG. 9 shows a head box according to another preferable embodiment of the invention, FIG. 10 shows a head box according to a third preferable embodiment of the invention, FIG. 11 shows a head box according to a fourth preferable embodiment of the invention, FIG. 12 shows a head box according to a fifth preferable embodiment of the invention, FIG. 13 shows a head box according to a sixth preferable embodiment of the invention, FIG. 14 shows a head box according to a seventh preferable embodiment of the invention, FIG. 1 shows a prior art foam process that can be considered to start from the pulper 10, wherein a foam is formed of at least liquid, preferably water, gas, preferably air, and a surfactant, into which foam fibre, fillers, pH regulators, stabilisators, colour and binders and other additives are further introduced for forming a foam suspension. Water is introduced into the pulper 10 via a conduit 14, through a pump 14 and a flow meter 16. The water can originally be from, for example, the water separation system of the production machine or from some other suitable source, including fresh water. Surfactant 20 is dosed into the pulper by means of a scale 18 or the like, suitable fibre material 24 is introduced by means of a scale 22 or the like, and fillers, stabilizers, colours, binders and pH regulators are dosed by means of a scale or a plurality of scales 26. Preferably each of these is introduced through their own measuring device. The gas content of a foam suspension thus produced can in normal atmospheric pressure and temperature range between 50 and 80%, in some cases even outside this wide range. The solids content of the foam suspension is between 2 and 25 percent, sometimes even lower than this, depending on the density of the foam, the type and length of the fibres and the product to be produced. This foam suspension is then introduced from the pulper 10 to the web forming wire 30 of the production machine via the head box 40 for producing the desired product. In the disclosed prior art foam process the solids, including the fibre material, surfactant and fillers, etc. mentioned above are introduced into the pulper 10. The mixing ratios of the materials are determined for example by introducing each material via a dedicated feed apparatus connected to a scale or mixing the amount necessary for correct ratio per time unit (kg/min). The necessary amount of water is introduced into the pulper as well, by means of a flow meter 16 so that the water and the surfactant form a foam, into which the solids are evenly disperged in the pulper.

In some cases a material can be introduced into the pulper only at the stage where the quantity can be measured from the foam in the pulper. This can be in connection with, for example, a pH regulator, in which case the pH of the foam in the pulper is measured and, according to the result, the pH value is regulated by introducing either an acid or base chemical into the pulper.

Essentially fibreless loam can also be introduced into the pulper 10 via line 38, the foam being returned from the suction boxes 32 of the web forming part with assistance from pump 36 either directly or via the wire pit 34.

Foam suspension is discharged from the pulper 10 as a constant flow with a pump 42 specially designed for this; the pump can be either a centrifugal pump or a displacement pump. The foam suspension can be pumped either directly to the head box 40, if its consistency is correct. It can also be pumped to the wire pit 34, where the consistency of the foam suspension is adjusted to be correct and from which the suspension is further pumped into the head box 40 or it can also be pumped into a storage tank 44, if using such is deemed necessary. From the storage tank 44 the foam suspension is preferably introduced for use by means of a pump 46.

When the foam suspension is introduced into the head box 40, according to prior art it is first fed into a header 50, wherein the foam suspension is distributed by means of nozzles 52 into a lube system 54, by means of which the foam suspension is fed into the actual head box 40. The nozzles 52 and the tube system 54 are described in more detail in connection with FIG. 2. Essentially fibre-free foam can also be brought from, for example, the wire pit 34 to the head box 40 and/or to the feed tube system to adjust the consistency of the foam suspension and/or the grammage of the product.

From the head box 40 the foam suspension is fed into the wire 30 of the web forming part, with suction boxes 32 arranged thereunder—or in broader terms—on the side opposite to the foam suspension for removing foam through the % wire 30 with suction. The foam removed from the web thus formed is directed into the vWire pit 34 or alternatively directly into the pulper 10 producing the foam suspension.

The web formed on wire 30 is directed to drying, possibly subsequent to being coated. The post-treatments performed for the web naturally depend on the demands of the product, so it is not necessary to discuss them here.

The inlet nozzles 52 and tube system 54 shown in FIG. 2 are arranged between the header 50 and the actual head box 40. A plurality of nozzles 52 have been arranged in the header 50, the inside surface of which is not cylindrical, but it comprises ridges or the like for increasing the turbulence level of the foam suspension prior to the tube system 54. The number of tubes in the tube system 54 equals the number of nozzles 52 in the header 50. The tubes 54 of the tube system are mostly arranged as a loop, as shown in the figure.

This shape of the tube and the nozzle are believed to keep the foam suspension uniform and to maintain an equal turbulence in all tubes of the tube system 54. The goal is naturally to allow the tubes to discharge into the head box 40 foam suspension, in which the fibres have not been flocked, but they can readily be evenly distributed onto the wire of the production machine.

In practice, however, it has been found that the nozzles 52 and tube systems 54 clog very easily. This risk is present especially when the length of the fibres increases in the foam suspension. This has presently been found problematic, to as the foam method has been taken into industrial use and it has been noticed that a vast number of different products can be produced by means of it. This means also, among other things, multi-layer products, in which one of the layers can be, for example, a reinforcing layer. Reinforcing mats produced by means of other methods have a fibre length of about 5 to 50 mm, mainly depending on the type of the fibre, so using similar fibre lengths is a necessity in the foam method as well. This has, however, been found to be difficult in practise, as fibres of such length, naturally depending on the fibre type, can flock very easily, and once in thin tubes, they can easily clog the whole tube.

It is further to be noted that even if the disclosure of FIG. 1 only mentioned one pulper, it is obvious that in some cases a larger number of pulpers is needed for the production. For example, when producing a multi-layer product, the necessary number of pulpers usually equals the number of layers. Further, if the process involves materials that are not to be allowed to contact each other, it is advisable to mix a separate foam suspension from both materials and materials that they are neutral to, and to mix the foam suspension only in foam formation stage, preferably just before the head box. In other words, with multi-layer web forming the number of necessary pulpers can easily be as high as six.

FIG. 3 shows schematically a prior art foam process: a head box 40, the tube system 54 preceding it and after the head box a web forming section with its wire 30 and suction boxes 32. The figure also shows, with reference number 48, a pump corresponding to the pump 48 of FIG. 1. In the line following the pump 48 there is both the header 50 and the tube system 54 of FIG. 2. The figure also shows how the head box 40 can feed the foam suspension directly to the web forming section to the gap between the two wires 30, unlike FIG. 1, which shows a more conventional web forming section comprising a Fourdrinier wire. FIG. 3 further shows how foam available from the suction boxes 32 arranged outside the webs 30 or the foam generally available from the web forming section can be fed by means of a pump 56 along line 58 to be mixed to with the foam suspension somewhere between pump 48 and the head box 40. Preferably this is done after header 50, in conjunction with either nozzles 52 or the feed tubes 54 or in the actual head box 40. Preferably the amount of the foam to be added can be regulated.

FIG. 4 shows a very similar head box 140 having foam inlet conduits 158' arranged in connection with the foam suspension conduits 154 for either diluting the foam suspension or equalizing the grammage of the product by adding foam. The conduit 158" is functionally similar, being arranged to bring foam to the ceiling of the head box 140, the foam from the conduit being directed along the top of the head box 40 towards the wire 130. The foam also acts as a lubricant to prevent orientation of the fibres in the foam suspension in the flow direction of the foam suspension.

FIG. 5 shows a third prior art head box solution 240 making it possible to produce a three-layer product. As shown in the figure, the head box 240 is vertically divided into three chambers 242, 244 and 246, each of which receives its own foam suspension from sources 248, 250 and 252. It is, however, possible that both surface layers (formed from the foam suspension in chambers 242 and 246) or even all layers are similar, but the shown technology gives the possibility to produce three different layers as well. The figure shows how the loam suspension introduced into each chamber 242, 244 and 246 is simultaneously directed to the web forming section between the webs 30. The web is quickly formed by removing foam in two directions by means of suction boxes 32 and the different layers of the web are adhered to each other due to the mixing of the fibres of the different layers on the border zone of the layers.

FIG. 6 shows yet another prior art head box solution 340. In this case three chambers 342, 344 and 346 have been arranged in the head box 340 either on top of each other or next to each other, depending on the installation position of the head box 340. Each of the chambers 342, 344 and 346 can feed their own layer to the web, as was described in connection with the previous figure. This to solution shows yet another way, compared to the chambers, of forming a separate layer or strip to the web. This is carried out by means of tubes 348 and 350 running through the chamber 344 feeding foam suspension that forms its own layers in the web, if on the one hand, the feed tubes 348 and on the other hand feed tubes 350 are located quite parallel in the longitudinal direction of the head box (perpendicular to the plane of the figure), or their own strips, if there are clear areas between feed tubes 348 and/or feed tubes 350 where the foam suspension is not spread from tubes 348 and 350. According a to a preferable embodiment the feed tubes can, in addition to being arranged in each chamber, should this be needed, be moved at least in their longitudinal direction. In practice, the longitudinal position of the feed tube determines the kind of layer or strip that the foam suspension discharged from the tube forms. The longer away from the opening place of the chambers the end of the tube is located, the longer the web forming from the foam suspension discharged to the web has proceeded and the sharper is the border of the foam discharged from the tube. If the feed from the tube takes place very quickly after the chambers have been opened to the web, the foam discharged from the tube is effectively mixed with other foam and the borders of the strip formed from the foam fed from the tube are very vague in comparison to the rest of the web.

FIG. 7 shows the production of a prior art product. The figure illustrates the production of a vehicle bumper body. According to the figure, the mould consists, naturally, of two parts 60 and 62 corresponding to the form of the bumper body. According to the technology described by the publication, a first thermoplastic fibrous mat 64 is placed on top of the lower mould part 62, with two narrower mat webs 66 and 68 being placed on top of the mat 64 at bith edges of the mat. A mat 70 corresponding to the lowermost mat is placed on top of these webs, and formable thermoplastic material 72 is placed on top of the last layer 70. When the mould parts 60 and 602 are compressed together, said thermoplastic material 72 is spread in all the mat layers 64-70.

It can easily be noticed from the manufacturing technique shown in FIG. 7 that it demands great precision and a lot of preliminary work to get all matting layers 64-70 to settle in correct places and to remain there throughout the manufacturing process. Further, at the plant there must be separate storage, transport and feed apparatuses for all necessary webs, and in this example there are six different webs. Further, the mats must be cut into correct sizes either at the plant or by the manufacturer of the mats. In practice this means that six webs of a certain width must be cut somewhere instead of being able to use only one web, if there were a way to attach all reinforcing webs in one product already at the manufacturing stage of the reinforcing product.

FIG. 8 shows an apparatus 76 for producing fresh foam and a production machine head box 78 according to the invention. As can be seen from the figure, the head box 78 mainly consists in this embodiment of an upwardly open or at least atmospheric basin 80, foam nozzles 94, bottom part 98 and a lip opening 100. The foam suspension is produced in the basin 80, into which the majority of the solids needed for the production of the actual product are introduced according to the same principles as used in prior art solution for introducing material into pulper or pulpers. In other words, the amounts introduced into the solids basin are measured for a certain production and the fibres or the fibre mat have been cut to the desired length by means of a cutter. Fibre can be introduced into the basin directly from the cutter (not shown) if the amount of fibrous material introduced into the cutter can be closely regulated. Fibre can also be introduced into the basin by means of a calibrated conveyor 82 so that a uniform amount of chopped fibre is constantly dropped into the basin 80. FIG. 8 also shows how another calibrated conveyor 83 is used for introducing e.g. filler, binder, colours or the like into the basin 80 or pre-produced mixture of these. An essential point of the invention is that at least a part of the said solids is brought into the basin essentially dry, not in a liquid suspension. The solids can, if necessary, by moistened, but in any case so that no free water is introduced into the basin with the solids.

A characterizing feature of a preferred embodiment of the invention is that an essential part of the fibre components needed for the construction of the product is introduced "dry" into the basin. The construction of the product means in this context the fibre network typical of the product, not a component possibly belonging to the product and having an effect on its properties in use, such as activated carbon or some liquid absorbent materials.

In addition to this, foam produced in a special foam pulper 84 is introduced into the basin 80. As shown already in FIG. 1, the foam is formed in the foam pulper 84 from water, surfactant and gas, suitably air, with the distinction that in this method no other materials are necessarily introduced into the pulper. However, if it is desirable to mix solids into the foam before basin 80, it can be done in connection with the forming of foam in a pulper 84. The amounts of water and surfactant are portioned in relation to each other when introduced into the pulper 84 for forming an optimal foam. The mixture of water and surfactant is mixed by means of a mixer so that air is entrapped in the mixture in an amount suitable for forming a desired gas content and bubble size.

It is possible and also practicable to replace at least a portion of the foam with foam returned from production via line 86, as shown with dash lines in the figure. Both the foam produced in the pulper 84 and pumped into line 92 by means of a pump 90, and foam returned from the process via line 86, are preferably sprayed in a desired amount per time unit into the basin 80 by means of nozzles 94 so that the solids are effectively mixed due to the turbulence caused by the foam jets, thus forming a uniform foam suspension. When the foam suspension is formed, it is led as a laminar flow via the bottom part 98 of the basin towards a lip opening 100.

Foam is fed from the nozzles 94 preferably with a velocity suitable for each fibre type; in other words, a velocity that will form a uniform foam suspension, but not so high as to cause too much turbulence in the fibres. Mixing can in certain circumstances be enhanced by arranging into the basin either a mechanical mixer (not shown) or by using ultrasonic or microwave mixing (not shown).

This embodiment of the invention differs from prior art foam suspension pulpers in that the solids must be introduced in a steady flow preferably for the whole length of the basin 80, corresponding to the width of the production machine wire. Thus also the foam is introduced into the basin from nozzles 94 located at about 10 cm intervals. Foam is preferably pumped to header tubes 96 arranged on both sides of the basin (in some cases, however, a header tube and nozzles are needed only on one side of the basin), from which the actual nozzles 94 lead into the basin, while the nozzles can naturally consist of longer nozzle tubes and actual nozzles arranged at the end of the tubes. According to another embodiment the header tubes are located essentially level with the upper edge of the basin 80, whereby the nozzle tubes with their nozzles can be led into the basin 80 from above it without making holes into the wall of the basin. The nozzles 94 can, if necessary, be arranged on opposite sides of the basin 80 either facing each other or staggered, depending on the desired turbulence. Nozzles 94 can further be arranged in several layers on either one or both sides of the basin 80, whereby it is possible to arrange a multi-stage mixing of fibres with the foam. Further, all nozzles 94 of one wall of the basin 80 can be unidirectional or their direction can vary as desired. The basin 80 of a preferred embodiment of the invention narrows in a downwardly direction, as shown in FIG. 8, so that the bottom 98 of the basin in fact forms a funnel, from which the foam suspension is fed as an essentially laminar flow to the wire or between the wires of the production machine. In some cases the basin can, however, be of uniform width until the lip opening 100 located in its bottom 98.

For the web forming process it is essential to maintain a constant surface level of the foam suspension in the basin 80. The surface level stays constant already for the reason that all components, i.e. the solids to be fed and the foam introduced via line 92, are introduced into the basin in closely measured amounts. In addition to this, a level control can naturally be arranged in connection with the basin for controlling both the introduction of solids and foam and, if necessary, line production of fresh foam.

A head box solution suitable for forming a three-layered web is shown as a preferred embodiment in connection with FIG. 9. In fact, in the embodiment the head box is only divided in three parallel parts 78', 78" and 78'" according to FIG. 8. If the completed three-layered product is considered, the parts 78', 78" and 78'" can also be arranged on top of each other. In this case the lip openings 101, 102 and 103 of the bottom parts of the basins 80', 80" and 80'" of the parts 78', 78" and 78'" of the head box are parallel, each feeding their own foam suspension to the web forming section between the wires 30. One or more of the lip openings 101, 102 and 103 can be arranged so as not to open between the wires 30 simultaneously with other openings, but slightly earlier or later. This procedure allows controlling how much the different layers of the web mix with each other. For example, the later the middle lip opening 102 opens into the web forming portion, the farther the forming of the surface layers has proceeded and the less the fibres of the middle layer can mix with the fibres of the surface layer.

With an apparatus according to FIG. 9 it is possible to form a three-layered web from even three different materials. Different solids can be fed into each of the basins 80', 80" and 80'" using, for example, the apparatus described in connection with FIG. 8. It is, however, preferable to feed the same fresh foam to all basins from the header tubes 96, whereby it is possible to use only one foam pulper. It can be stated in this context that in some cases it is preferable to mix, in connection with the production of foam, solids to the foam in the foam pulper, the solids being common to all the layers of the web. An example of this might be, for example, a binder or a fibre component common to all the layers.

However, it is also worth mentioning that in some cases the materials used for different layers of the web differ so much from each other that it is not preferred to use exactly similar foam in all the layers. In this case, different foams are naturally produced in different pulpers and fed to the head box basins via their own tube systems. This kind of an arrangement makes it possible to feed, for example, a certain binder to some layers of the web with the fresh foam, the binder being suitable just for the fibres used in these layers.

It should, however, be noted from the above that it can be applied to production of one-, two-, three-, or multi-layered products. Thus, the above should only be considered an example of many variations of the invention, only.

In the embodiments shown in FIGS. 8 and 9 the basins are arranged essentially vertically. The web forming section, consisting of two opposed wires and suction boxes 32 arranged outside the wires, is also essentially vertical.

FIG. 10 further shows how the wire 30 and the suction boxes 32 can be arranged horizontally, if preferred, due to the inclined bottom parts 98', 98" and 98'" of the head box, even if the actual head box or at least their upper basin part 80', 80" and 80'" used for mixing the foam suspension is vertical.

The head box solutions according of the invention, shown above in FIGS. 8-10, clearly illustrate how the head box is upwards completely open in these embodiments. That will make it possible to feed a variety of materials to the web to be formed simply. It is, for example, fully possible to feed for example glassfibre, metal thread, a ribbon or the like into one or more of the layers of the product. Other usable materials that can be fed into the product according to the invention by means of the above head box are, for example, different textile, carbon fibre, aramide fibre and polyester fibre ribbons and the like, electrically conductive threads, ribbons or cables, optical fibres and the like, different resistor wires or nettings, other nets, materials changing colours on as a function of temperature and so on.

This is exemplified in FIG. 11, which shows production of a product according to a preferred embodiment of the invention utilizing an apparatus with the basic structure like that shown in FIG. 8. The figure shows, how a continuous fibre, to yarn, ribbon or the like is introduced to the web via basin 80. In the embodiment of the figure, the continuous yarn 106 or the like is spooled from a roll or the like (not shown) or in some cases even directly from production, from a folding roll 108 between two control rolls 110. The control rolls 110 adjust the feed speed of the yarn 106 to correspond to the speed of the web in the production machine. It is therefore a characterizing feature of this embodiment that the yarn or the like stays in a direct line parallel to the web. The straightness of the yarn even in this basic form of a head box is helped by the fact that the turbulence needed for forming the foam suspension is so weak that it cannot greatly deflect the yarn from the desired direction. Feeding a yarn like this in water method is not possible, as in the water method the turbulence in the head box would make the yarn wave so strongly that its final place in the end product would be random. A way to ensure the yarn being ends up exactly to the right place in the end product is to direct the yarn or the like through the turbulence zone of the head box to the area of the laminar flow by means of suitable tubes.

In addition to the yarn 106, the solution shown in FIG. 11 can be used for introducing a product of a remarkably wider dimension in the width direction of the web or the production machine. An example of these is a net extending essentially to the whole width of the product to be produced, with the net being made from almost any material desired. An example of this is a resister wire net for connecting the end product to an electric system for warming. Another alternative from numerous possibilities is a prefabricated reinforcing mat, which for some reason cannot be produced simultaneously with the product being produced with the method. The mat is directed from a roll via control rolls to the basin and from there further into the web. A third alternative is, for example, introducing a perforated, thin steel plate or a narrow steel strip via the basin to the web. The binding of the steel plate to the web is ensured by the binding of fibres and resin through the holes of the plate.

A solution utilizing the control rolls 110 for feeding firstly the yarn, ribbon, net or the like to the web at the same speed as the web is moving, can be mentioned to here as an additional embodiment. When the production is started, said control rolls can be considered to slightly brake the speed of the yarn or the like. This is to ensure the tightness of the yarn or the like, so that it sets in the desired location in the product and cannot move in any direction. Another way of stopping the yarn or like from moving perpendicularly to its feed direction is to arrange guides in connection with the lip opening 100 for guiding the yarn or the like to the right place in the web. It is naturally also possible to introduce the yarn, ribbon, net or the like by means of a guide only to the area of the laminar flow to the bottom part of the basin or, if desired, quite deep into the web forming section, between the wires.

FIG. 12 shows a preferred head box solution according to the invention, in which a continuous fibre yarn or the like 112 is introduced via the middle basin 80" into the web being formed. The figure shows, how control rolls 110 introduce the yarn or the like 112 at a speed exceeding the speed of the web. The idea is to form a separate layer from the yarn or the like 112, preferably for example glass fibre, onto which layer the yarn, fibre or the like is evenly folded. Introducing a "loose" yarn or the like element into the web could not succeed with the water method, because with the water method the fibres in the fibre suspension would be caught on the yarn because of the high turbulence, so that an even distribution of the fibres on the product would be impossible. Also in the case of this embodiment, the feed apparatuses 82 and 83 are also used for feeding into the basin 80" other solids, such as fillers, binders and/or some non-continuous fibre component.

It is obvious, that in the case of FIGS. 11 and 12 there can be one or more threads or the like along the width of the product. As already mentioned above, the yarns or the like can be fed in an amount sufficient to form a whole layer in a laminate. It is further possible to feed the fibre, yarn or the like on its own between two or more of the layers without foam or loam suspension. It is also possible to feed continuous fibre, yarn, net, web or the like into the formed web, as shown in FIG. 11, via the basins 30' and/or 80''', using e.g. a solution as shown in FIG. 12. It is accordingly obvious that continuous yarn or the like can be introduced into any layer of the web also at a speed exceeding the speed of the web. Thus the feed solutions of the basin 80'' shown in FIG. 12 can also be arranged in connection with the other basins 80' and/or 80''', if desired.

FIG. 13 further shows another preferred embodiment of a head box and a web forming method according the invention. The figure shows the manufacture of a bumper body discussed already in connection with FIG. 7 using the new foam method so that all the layers needed for the bumper body are fed into the same web, whereby the bumper body can be manufactured simply in one production phase from a single laminate mat by just adding resin.

FIG. 13 shows, how two feed tubes 114 and 116 have been led through the middle basin 80'' of the head box, slightly past the lip opening 100 of the head box, to the gap of the web forming section. For a product shown in FIG. 7, material needed for the surface layer 64 is fed from basin 80' and material for the surface layer 70 is fed from the chamber 80'''. In addition to this, it is possible to feed a so-called flow layer between the surface layers from the middle chamber 80'', in which layer the resin is evenly spread throughout the product. On the other hand the tubes 114, a number of which are preferably arranged across the width of the product, i.e. in the longitudinal direction of the head box, are used for feeding another foam suspension, needed for forming a web formed of thinner mat webs 66 and 68 shown with reference number 66 in FIG. 7, the web being located between the surface layers 64 and 70. Tube 116 is accordingly used for feeding foam suspension forming the mat web 68 in the completed product. The figure shows a situation, in which the tubes 114 and 116 are used for feeding fibre suspension in foam form. The same end result can be achieved by means of feeding a narrow fibre web or ribbon to the above-mentioned places in the web, as shown in FIG. 11. A web with a number of product blanks side by side can be produced by arranging the feed tubes 114 and 116 illustrated in the figure with suitable intervals along the whole length of the head box, the blanks can then later be cut into separate, narrower webs of their own for example in connection with rolling of the product.

Even if it has in the above been disclosed that the same foam suspension is fed through tubes 114 and 116, it is naturally possible to introduce a different foam suspension in each of the tubes. In a corresponding way it is possible to form one of the narrower layers by means of a foam suspension, and the other by means of a completed web. The head box according to the invention allows the production method to be freely chosen according to the requirements and possibilities of the product.

It is naturally obvious that if one wants a product according to FIG. 7 having reinforcing layers in the edge regions between two surface layers, it is possible to manufacture the product not only by means of an apparatus according to FIG. 13, but also by forming the end of the single feed tube so that the thickness of the introduced foam suspension spray changes. In this case, the thicker portion of the spray corresponds to two superimposed fibre webs or ribbons and the thinner part only corresponds to the wider one of these fibre webs or ribbons.

FIG. 13 further shows how the foam suspension is brought to the head box via tubes 114, 116. In other words, the foam suspension has been separately formed, in a small pulper suitable for the purpose if desired. Another possibility is to arrange a small basin for this foam suspension, the suspension being both produced in the basin and fed therefrom into the web to be formed between the layers.

Further, the tubes led through the chamber or chambers of the head box can be used for feeding into the web, in addition to completed web or foam suspension, also solids needed in the product. The solids can be, for example, simply chopped fibres, binder, a mixture of binder and chopped fibres or some so other material, with no connection to the actual layer forming. In this case the material can, for example, be SAP (super absorbent polymer), which is used for absorbing liquids, or e.g. a ribbon with seeds fastened to it at fixed intervals.

It is additionally obvious that the tubes 114 and/or 116 can be replaced with flat nozzle channels extending in the width direction of the web, which are being able to form a wide strip in the web. And, as has been disclosed in prior art, the tubes or jet channels can be longitudinally movable, whereby the introduction point of the material in the web forming section can be adjusted to suit the application. The tubes and/or nozzle channels can naturally also be made movable in the perpendicular and/or thickness direction of the web as well, if it is for some reason desired to form wave-like strips in the longitudinal direction of the web.

FIG. 14 further shows another head box solution 178 according to a preferred embodiment of the invention. The main difference to the head boxes described above is that in this embodiment the head box is closed, i.e. pressurized, while in the other embodiments the head box has been atmospheric. In practice the only difference of the embodiment of FIG. 14 to the embodiment of for example FIG. 8 is that the chopped fibre and other solids are now introduced through the lid 179 of the head box 178 by means of rotary feeders 182 and 183 or other corresponding high-pressure feed apparatus. Quite correspondingly, if the application calls for feeding a continuous yarn, cable, fibre or the like through the head box to the web to be formed, the material must be introduced via a pressure-resistant conduit. Sealing rolls, air-tightly sealed against the lid of the head box can be considered examples of pressure-resistant conduits, with the yarn, ribbon or the like being passed from atmospheric pressure to the pressurized head box. Another solution would naturally be to arrange the complete roll or spool of material in a pressurized space.

The above-mentioned exemplary embodiments disclose that the discussed new type of a foam method will allow production of almost any kind of fibre-based products. Thus, both inorganic and organic fibres can be used as fibre materials either on their own or together with each other. Different glass fibres, carbon fibres, quartz fibres, ceramic fibres, zirconium fibres, boron fibres, tungsten fibres, molybdenum fibres, beryllium fibres and different steel fibres can be mentioned as examples of inorganic fibres. Examples of organic fibres include polyamide fibres, polyester fibres, polyethylen fibres, acetate fibres, acryl fibres, melamin fibres, nylon fibres, modacryl fibres, olefine fibres, lyocell fibres, rayon fibres, aramide fibres and various natural fibres, such as sisal and jute fibres. The above-mentioned fibres can be used either as separate single fibers or as different fibre bundles. Also, all fibre lengths can be used, from a very short length of only a few millimetres to a fully continuous fibre.

As is clear from the above, a new type of product series has been developed, which can be produced ony by means of the above-mentioned new kind of foam web forming. It should be noted that in the above the term "foam" has been used throughout the text to describe either fresh foam produced from water and surfactant, or reusable foam recycled from the suction boxes of the production machine, whereby an essential part of the solids have been retained to the product on the wire. Thus "foam" could be determined to mean essentially fibre-free foam. Ene term "foam suspension", on the other hand, means foam containing fibres and/or solids, i.e. in principle foam on its way to the production machine to yield an essential part of the solids onto the wire.

We claim:

1. A method for forming a fibrous web comprising the steps of:

(a) introducing a fibrous foam suspension of solids directly from a head box of a production machine to a web forming section thereof, and (b) removing foam through at least one wire located in the web forming section of the production machine to thereby form the fibrous web, wherein (c) at least a part of the solids needed for forming the fibrous foam suspension is mixed into the foam in the head box by spraying the foam from nozzles into the head box.

2. A method according to claim 1, wherein the foam is separately produced in a foam pulper.

3. A method according to claim 1, wherein a part of the foam is acquired from the web forming section of the production machine.

4. A method according to claim 1, further comprising mixing in the head box fibrous material in chopped form into the foam for forming the fibrous foam suspension.

5. A method according to claim 1, comprising mixing in the head box binders, fillers, and/or colours into the foam.

6. A method according to claim 1, wherein all solids needed for forming the fibrous foam suspension are introduced into the head box with the foam being sprayed into the head box to thereby form the fibrous foam suspension.

7. A method according to claim 1, comprising dividing the head box into a number of parallel or superimposed parts for forming a multi-layer web.

8. A method according to claim 7, comprising introducing at least partly different solids into each part of the head box.

9. A method according to claim 7, wherein solids common to two or more layers of the web formed by means of the parts of the head box are introduced into two or more of the parts of the head box with the foam introduced thereto.

10. A method according to claim 1, comprising introducing continuous fibrous material into the web to be formed via the head box.

11. A method according to claim 10, wherein the head box is formed of more than one part and wherein the continuous fibrous material is introduced into the web to be formed via at least one part of the head box.

12. A method according to claim 1, comprising introducing a ribbon, net, mat or other essentially flat material is introduced on the web to be formed via the head box.

13. A method according to claim 10 or 12, wherein the web is formed at a web forming speed, and wherein the material introduced into the web at a speed which is the same as the web forming speed.

14. A method according to claim 10 or 12, wherein the web is formed at a web forming speed, and wherein the material is introduced into the web at a speed higher than the web forming speed.

15. A method according to claim 12, wherein the head box is formed of more than one part and wherein the ribbon, net, mat or other essentially flat material is introduced into the web to be formed via at least one part of the head box.

16. A method according to claim 1, comprising introducing a continuous material into the web to be formed via the head box.

17. A method according to claim 16, wherein the head box is formed of more than one part, and wherein the continuous material is brought into the web to be formed by at least one part of the head box.

18. A method according to claim 16 or 17, wherein the continuous material is a fibre, thread and/or cable.

19. A method according to claim 1, wherein means for feeding material straight in the web forming section into the web being formed are guided via the head box.

20. A method according to claim 19, comprising positionally adjusting the means in a moving direction of the web and/or in any direction perpendicular the moving direction of the web.

21. A method according to claim 19, wherein the means comprise tubes or nozzle channels.

22. A method according to claim 19, wherein the material is chopped fibre, binder, filler, SAP, ribbon, fibre web or foam suspension.

23. A method according to claim 1, wherein the head box is formed of more than one part, and wherein means for feeding material straight in the web forming section into the web being formed are guided via at least one part of the head box.

24. An apparatus for forming a fibrous web comprising:

a head box having one or more lip openings, and a web forming section, in direct communication with the one or more lip openings, at least one wire, and foam removal means located on a side of the at least one wire opposite to the formed web, wherein the head box further includes means for receiving foam, means for introducing at least one solid material to the head box, and feeding nozzles for spraying foam and thereby mix the at least one solid material into the foam to form a foam suspension.

25. An apparatus according to claim 24, wherein the means for receiving foam comprise a basin of the head box, and wherein the means for mixing solid material comprise nozzles for spraying foam into the basin of the head box.

26. An apparatus according to claim 25, further comprising at least one foam header tube outside the head box from which foam is distributed to the nozzles.

27. An apparatus according to claim 26, further comprising at least one foam pulper and a pump and a tube system connecting the at least one foam pulper to the at least one foam header tube.

28. An apparatus according to claim 27, wherein the foam pulper includes a mixer and means for dosing surfactant and water into the foam pulper.

29. An apparatus according to claim 27, wherein the foam pulper includes means for dosing at least one solid material into the foam pulper.

30. An apparatus according to claim 26, further comprising a flow route for connecting the at least one foam header tube to the foam removal means.

31. An apparatus according to claim 25, wherein the nozzles are arranged on opposing walls of the basin of the head box so that the sprays discharged from the nozzles are staggered.

32. An apparatus according to claim 25, wherein the nozzles are arranged on opposing walls of the basin of the head box so that the sprays discharged from the nozzles are directly opposite each other.

33. An apparatus according to claim 24, further comprising at least one dosing device for dosing the solid material.

34. An apparatus according to claim 33, wherein the dosing device comprises a conveyor or a chopper connected to a scale.

35. An apparatus according to claim 24, wherein the solid material introducing means includes a feed apparatus for allowing feeding into a pressurized space.

36. Apparatus according to claim 35, wherein the feed apparatus includes a rotary feeder.

37. An apparatus according to claim 25, wherein the nozzles are located on different heights on at least one wall of the basin of the head box.

38. An apparatus according to claim 24, wherein the head box comprises a number of parts arranged side by side for forming layers on the web to be formed.

39. An apparatus according to claim 38, wherein the location in a moving direction of the web of at least one lip opening of at least one part of the head box is adjustable in relation to at least one other lip opening.

40. An apparatus according to claim 24, wherein the head box includes means for introducing continuous material via the head box into the web being formed.

41. An apparatus according to claim 40, wherein the means for introducing material includes at least control rolls for adjusting the feed velocity of the continuous material.

42. An apparatus according to claim 40, wherein the means for introducing material further includes control means arranged in the head box near to the lip opening for adjusting the position of the material in the web to be produced.

43. An apparatus according to claim 40, wherein the introduction means includes at least one tube which is fixed or movable at least in the longitudinal direction of the web.

44. An apparatus according to claim 24, wherein the head box includes means for introducing material into the web being formed up to the web forming section.

45. An apparatus according to claim 44, wherein the material is chopped fibre, binder, filler, SAP, fibre, web ribbon or a foam suspension containing at least foam and a solid material.

46. An apparatus according to claim 24, wherein the head box is operable at atmospheric pressure.

47. An apparatus according to claim 24, wherein the head box (178) is pressurized and comprises a pressure resistant feeder.

* * * * *